US006840409B2

(12) United States Patent
Dambricourt

(10) Patent No.: US 6,840,409 B2
(45) Date of Patent: Jan. 11, 2005

(54) PACKAGING FOR FLUID PRODUCT WITH HINGE CLOSURE

(75) Inventor: Géry Dambricourt, Escoutoux (FR)

(73) Assignee: CEP Industrie, Saint-Remy sur Durolle (FR)

( * ) Notice: Subject to any disclaimer, the term of this patent is extended or adjusted under 35 U.S.C. 154(b) by 51 days.

(21) Appl. No.: 10/296,877

(22) PCT Filed: May 29, 2001

(86) PCT No.: PCT/FR01/01658

§ 371 (c)(1),
(2), (4) Date: May 20, 2003

(87) PCT Pub. No.: WO01/92120

PCT Pub. Date: Dec. 6, 2001

(65) Prior Publication Data

US 2004/0099692 A1 May 27, 2004

(30) Foreign Application Priority Data

May 29, 2000 (FR) ..... 00 06834

(51) Int. Cl.[7] ..... B65D 37/00
(52) U.S. Cl. ..... 222/212; 222/546
(58) Field of Search ..... 222/212, 545, 222/546, 556, 563

(56) References Cited

U.S. PATENT DOCUMENTS

| | | | | | |
|---|---|---|---|---|---|
| 3,157,314 | A | * | 11/1964 | Nadler | 222/88 |
| 3,877,598 | A | * | 4/1975 | Hazard | 215/224 |
| 3,948,422 | A | | 4/1976 | Micallef | 222/517 |
| 5,037,006 | A | * | 8/1991 | Kock | 222/190 |
| 6,152,324 | A | * | 11/2000 | Baudin | 222/1 |
| 6,202,901 | B1 | * | 3/2001 | Gerber et al. | 222/494 |

FOREIGN PATENT DOCUMENTS

| | | |
|---|---|---|
| FR | 2 655 948 | 6/1991 |
| FR | 2 773 537 | 7/1999 |

* cited by examiner

*Primary Examiner*—Joseph A. Kaufman
(74) *Attorney, Agent, or Firm*—Young & Thompson

(57) ABSTRACT

A packaging for fluid product such as a cream or a paste, has a flexible tube (1) provided with a dispensing neck (11), and a convenience closure system (2), including an annular base (20) fixed to the tube (1) on the neck side (11), and a top (21) mobile relative to the base (20). The neck (11) is formed by the wall (10) of the tube which converges towards the main axis (X) of the tube in the direction of the opening (100) with a relatively large radius with respect to its circumference, and the base (20) is engaged in the opening (100) of the tube, and causes the neck (11) to be radially stretched, and is locked relative to the opening along the main axis (X).

16 Claims, 3 Drawing Sheets

PACKAGING FOR FLUID PRODUCT WITH HINGE CLOSURE

The present invention relates in general to packaging for containing a fluid such as a cream or a paste.

More precisely, the invention relates to packaging of the type comprising a hollow body and stopper means, the hollow body being a flexible tube defined by a wall suitable for being subjected at least locally to reversible deformation and terminating in a neck pierced by an opening centered on a main axis, and the stopper means comprise an annular base fixed to the opening in order to define therein a dispenser orifice for the fluid, and a stopper having a closure finger, said stopper being connected to the base via a hinge link and being selectively movable relative to the base by turning through an angle of more than 90° between a first position in which the finger closes the dispenser orifice and a second position in which the orifice is released.

Such packaging which enables fluids that can be very viscous to be contained for ejection from the hollow body by applying pressure to the wall thereof are in widespread use in the fields of cosmetics, pharmacy, and foodstuffs, the stopper means for such packaging being commonly referred to as a "convenience cap".

In particular, packaging is known in which the stopper means or "convenience cap" enable the packaging to stand on the stopper so as to cause the fluid to flow under gravity towards the dispenser orifice.

In spite of being generally advantageous, such packaging gives rise to drawbacks in use which the present invention seeks specifically to eliminate.

For this purpose, the packaging of the invention, otherwise in accordance with the generic definition given in the introduction above, is essentially characterized in that the neck is formed by the wall of the tube which converges on the main axis going towards the opening, in that the neck presents a determined minimum radius in a longitudinal plane containing the main axis, in that the hollow body presents a determined circumference in a plane extending across the main axis and situated halfway between the ends of the hollow body, in that the ratio of the determined circumference over the minimum radius is not greater than five, and in that the base is engaged in the opening, putting the neck under radial tension, and is prevented from moving relative to the opening along the main axis.

Thus, instead of surrounding the neck as is the case in the prior art, the base of the stopper means of the invention is inserted into the neck, which characteristic leads to two series of advantages.

Firstly, the base may be of a diameter that is smaller than that presented by the base in the prior art, thus leading to savings in material and to improved comfort in use that results from the reduction in the area of the base onto which the fluid extracted from the packaging becomes spread.

Furthermore, the overall length of the packaging can be shortened so that when the packaging can be placed on its stopper, the center of gravity of the upside-down packaging is lowered, which for a stopper having the same perimeter provides better stability for the packaging in said position.

Numerous packages have already been proposed in the prior art, as can be seen from patent documents FR 2 655 948, U.S. Pat. No. 3,948,422, and FR 1 513 568.

Although none of those packages corresponds to the generic definition of the invention as given in the introduction above, each of those prior documents describe packaging that presents at least some of the characteristics of the invention.

Nevertheless, none of those documents discloses the specific problem which the invention seeks to solve, nor does it suggest using all of the means which, taken together, define the context of the problem and solve it.

In a preferred embodiment of the invention, the base pinches the wall of the hollow body around the opening, which pinching may be substantially parallel to the main axis, and the base can pinch the wall of the hollow body across its thickness.

In a possible embodiment, the wall of the hollow body converges progressively and monotonically towards the main axis on going towards the opening.

In the simplest embodiment of the invention, the base has barbs whereby the base is secured to the neck.

These barbs may be carried by elastically flexible tabs secured to a collar surrounding the opening to the outside of the hollow body, said tabs being engaged in the opening of the hollow body, and extending at least approximately parallel to the main axis.

In a variant, the barbs may nevertheless be carried by a substantially cylindrical skirt engaged in the opening of the hollow body and secured to a collar surrounding the opening, outside the hollow body.

By way of example, the link comprises a strap matching the outline of the neck of the hollow body, and a hinge connecting the strap to the stopper.

The end of the flexible tube remote from the neck and which is initially open may be closed after the tube has been filled by pinching together and heat-sealing the wall of the tube, in conventional manner.

The invention makes it possible to provide packaging using a hollow body whose wall is deformable, including around the opening.

This characteristic which makes it possible to design packaging that can be emptied completely and more precisely a tube that can be emptied completely, is particularly advantageous.

In prior art packages, where the stopper fits over the neck, the wall of the hollow body cannot easily be made deformable all the way to the opening since otherwise the neck could escape spontaneously from the base merely by deforming.

To further increase the comfort of use of the packaging of the invention, it is advantageous to provide for the wall of the hollow body around the opening to be defined by a generator line that is inclined at an angle of no more than 45°, and preferably no more than 30° relative to the main axis.

In the preferred embodiment of the invention, the ratio of the determined circumference to the minimum radius is not greater than two.

As mentioned above, the stopper may be shaped so that in its first position it provides a stand for the packaging, which can thus be stood on the stopper.

Finally, to improve the stability of the packaging when stood on its stopper, while minimizing the height of the flank of the stopper and while avoiding having a gap between the wall of the neck and the end of the flank of the stopper, it is advantageous for the stopper to present, in its first position, a first edge that is relatively far away from the neck and of perimeter that is relatively large, together with a second edge that is relatively close to the neck and of a perimeter that is relatively small.

By means of the essential characteristics of the invention, the stopper in its first position can cover the entire base of the stopper means.

Other characteristics and advantages of the invention appear clearly from the following description given in purely indicative and non-limiting manner with reference to the accompanying drawings, in which.

Figure 2:
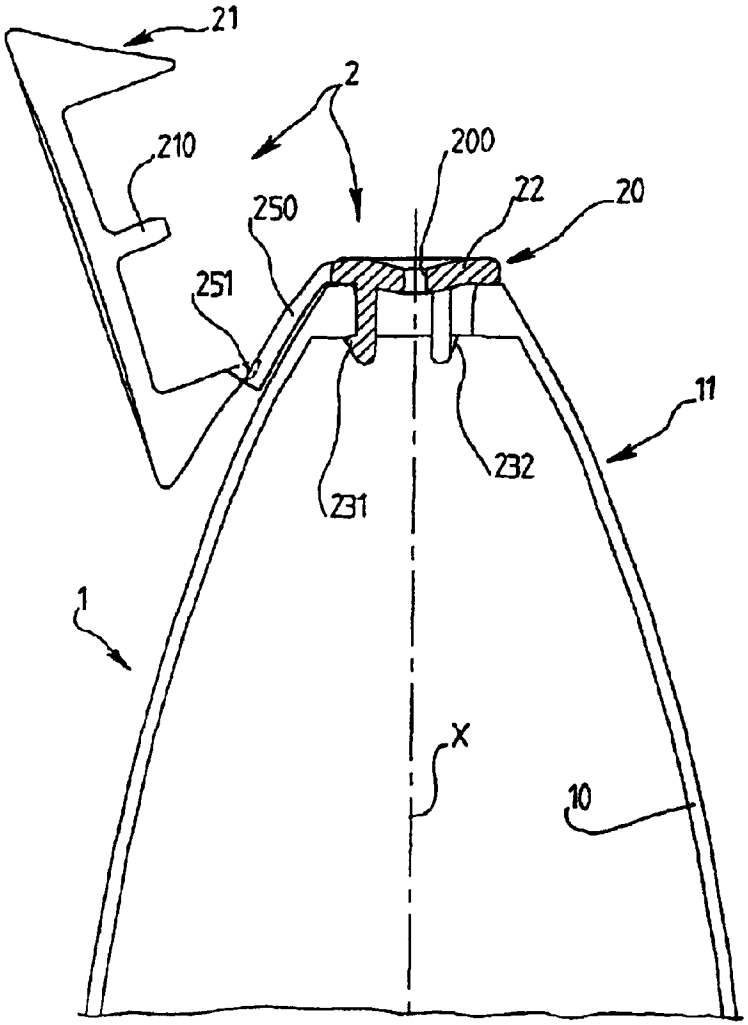
FIG. 2 is a fragmentary section view similar to FIG. 1, showing the same packaging in the open state.

As shown in the figures, the invention relates to packaging that is intended to contain a fluid such as a cream or a paste, the packaging essentially comprising a hollow body 1 and stopper means 2.

The hollow body 1 is a tube defined by a wall 10 that is flexible, resilient, and deformable, and which can therefore be indented reversibly by applying pressure thereto, in particular in a portion that is easy to hold, so as to enable the fluid contained in the tube to be ejected.

The opening 100 of the tube is centered on its main axis X, at the top of a neck 11 which is generally constituted by the wall of the hollow body converging towards the axis X.

Figure 4:
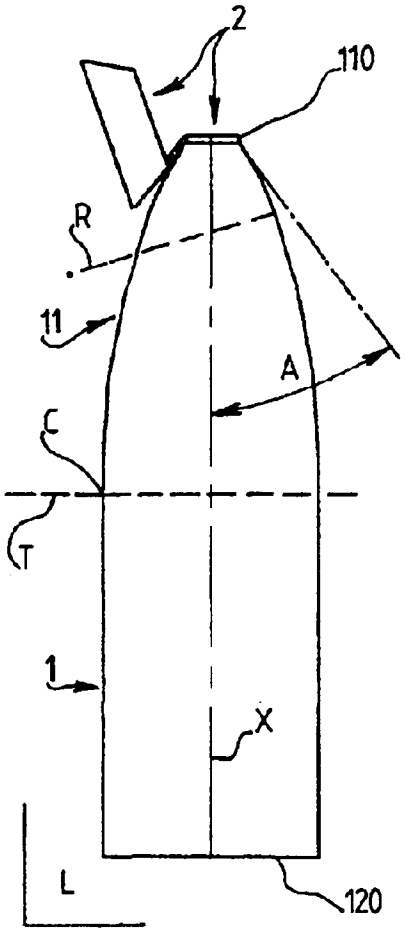
FIG. 4 is a side view similar to FIG. 3 showing the same packaging in the open state.
Figure 3:
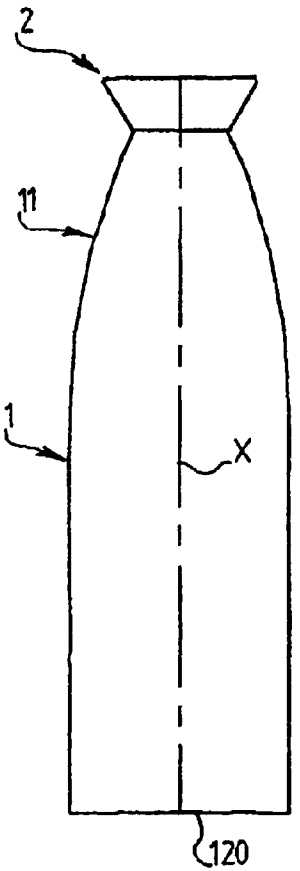
FIG. 3 is a side view on the packaging shown in FIG. 1, shown in full, in the closed state, and on a smaller scale, prior to the bottom end 120 of the tube being heat-sealed.

The stopper means 2 essentially comprises an annular base 20 and a stopper 21, which stopper can be moved at will relative to the base 20 in order to close the packaging (FIGS. 1 and 3) or to open it (FIGS. 2 and 4).

More precisely, the annular base 20 is fixed to the opening 100 of the hollow body 1 and is pierced by a channel defining a dispenser orifice 200 for the fluid, the stopper 21 having a finger 210 (FIG. 2) that stoppers said dispenser orifice 200 when the packaging is closed.

The stopper is connected to the base 20 via a hinge link 25 and is therefore capable of turning relative to the base 20 through an angle of more than 90° between a closed position (FIG. 1) in which the finger 210 closes the dispenser orifice 200, and an open position (FIG. 2) in which the orifice 200 is released.

In the packaging of the invention, the neck 11 is formed by the wall 10 of the tube which converges towards the main axis X going towards the opening 100.

The minimum radius R presented by said neck 11 in a longitudinal plane L containing the main axis X, i.e. specifically in the plane of FIG. 4, is relatively large relative to the circumference C that the tube presents in a transverse plane T extending across the main axis X and situated midway between the ends 110 and 120 of the tube.

More specifically, it is advisable for the ratio C/R of said circumference C over said minimum radius R to have a value no greater than five, or even a value no greater than two.

Finally, the base 20 is engaged in the opening 100, and is prevented from moving relative to the opening 100 along the axis X, putting the neck 11 under radial tension, i.e. exerting a force on the opening which tends to increase its diameter.

In a preferred embodiment of the invention, the base 20 pinches the wall 10 of the tube 1 around the opening 100.

Figure 1:
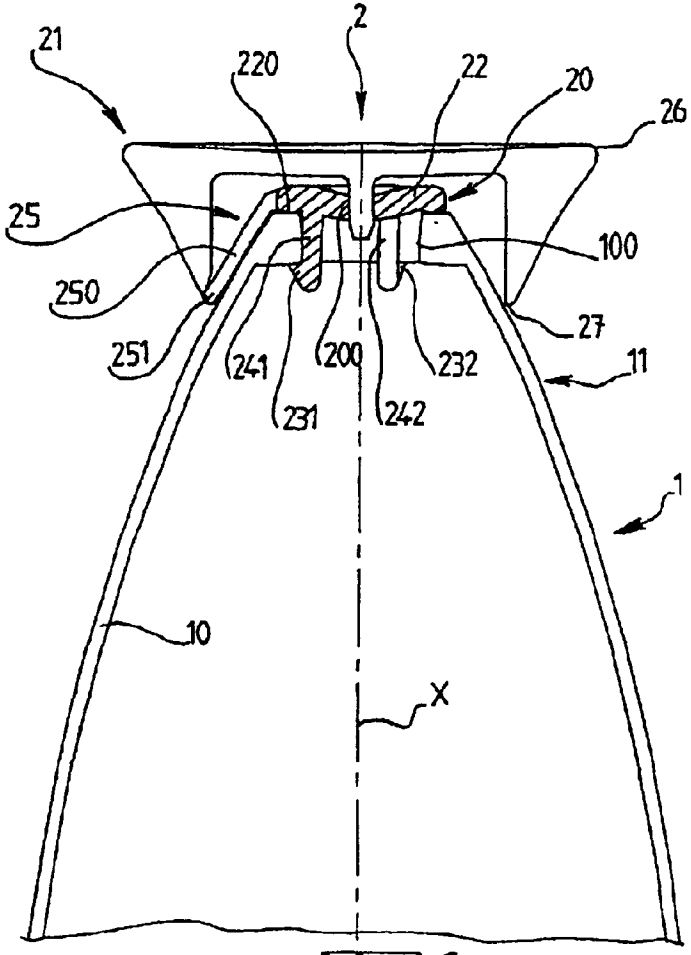
FIG. 1 is a fragmentary section view on an enlarged scale of a first embodiment of packaging of the invention, shaped to form a tube and shown in the closed state.
Figure 5:
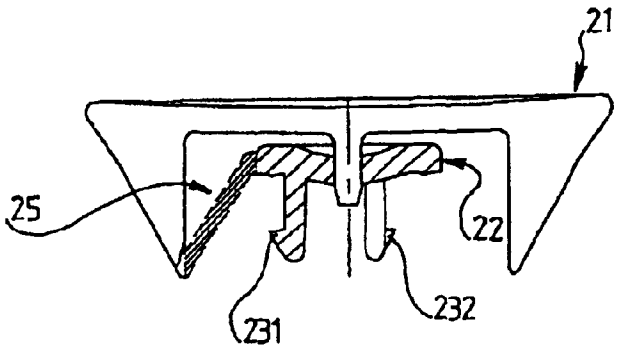
FIG. 5 is a section view showing more particularly the stopper means of the FIG. 1 packaging in the closed state.
Figure 7:
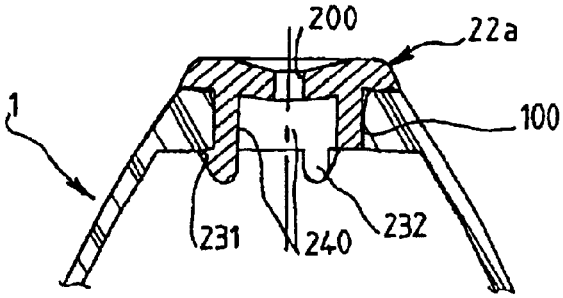
FIG. 7 is a fragmentary section view on an enlarged scale of a second possible embodiment of packaging of the invention.
Figure 8:
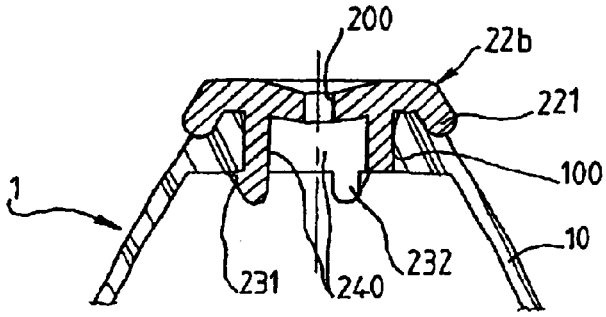
FIG. 8 is a fragmentary section view on an enlarged scale of a third possible embodiment of packaging of the invention.
Figure 9:
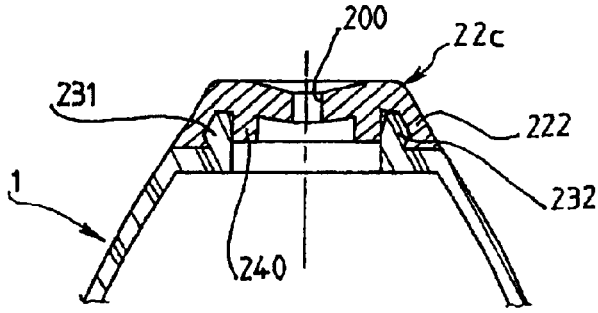
FIG. 9 is a fragmentary section view on an enlarged scale of a fourth possible embodiment of packaging of the invention.
Figure 11:
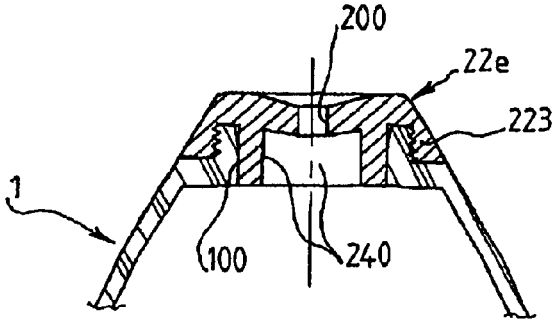
FIG. 11 is a fragmentary section view on an enlarged scale of a sixth possible embodiment of packaging of the invention.

The base 20 can thus pinch the wall 10 of the tube 1 in a direction that is substantially parallel to the main axis X, as shown in FIGS. 1, 2, and 7, or in a radial direction as shown in FIG. 11, or both in a direction that is substantially parallel to the main axis X and in a radial direction, as shown in FIGS. 8 and 9, the wall 10 being suitable for being pinched in particular in its thickness.

The base 20 may be held relative to the opening 100 along the main axis X by means of barbs such as 231 and 232 carried by the base 20 and possibly serving to pinch the wall 10 of the tube 1 parallel to the main axis X.

These barbs which are advantageously disposed inside the neck 11 may nevertheless be disposed outside the neck (FIG. 9) and they may be elastically movable in a radial direction relative to the main axis X.

As shown by the embodiment of FIGS. 1 and 2, the barbs 231 and 232, which are three in number, for example, being disposed at 120° relative to one another as shown, can be carried by elastically flexible tabs such as 241 and 242, provided with the corresponding number, and secured to a collar 22 surrounding the opening 100 outside the tube 1, which tabs extend at least approximately parallel to the main axis X and are engaged in the opening 100 of the tube.

Under such conditions, the wall 10 of the tube 1 which may optionally present greater thickness around the opening 100 (FIGS. 1 and 2), is pinched across its thickness between the collar 22 and the barbs such as 231 and 232.

Figure 6:
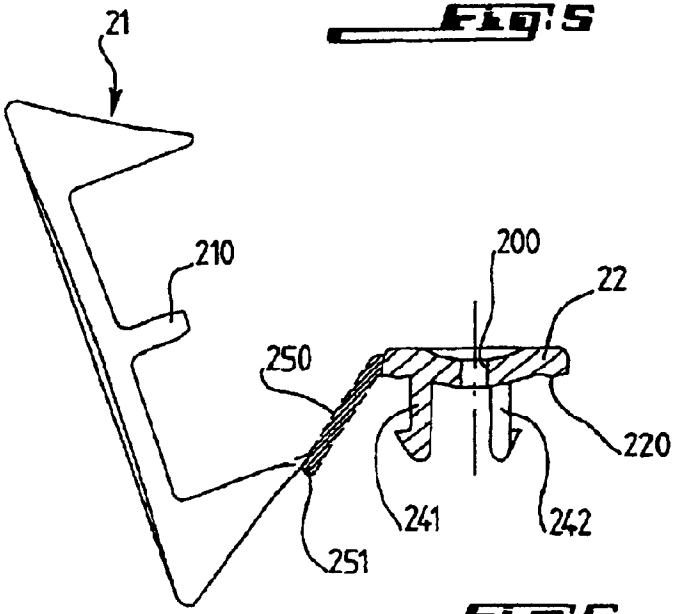
FIG. 6 is a side view showing more particularly the stopper means of the FIG. 2 packaging in the open state.

In order to avoid any of the fluid contained in the packaging escaping or leaking out, the collar 22 is then, for example, pressed in leaktight manner against the opening 100 by means of an annular rib 220 surrounding the opening 100, as can be seen in particular in FIG. 6.

In a preferred variant shown in FIG. 7, the barbs 231 and 232 are carried by a substantially cylindrical skirt 240 engaged in the opening 100 of the tube and secured to a collar **22*a* surrounding the opening 100**.

In this case, and also in the variants of FIGS. 8 to 11, sealing can be obtained between the base 20 and the opening 100 directly by means of the radial pressure exerted by the skirt 240 on the opening 100.

FIG. 8 shows a variant in which the collar **22*b* has a peripheral rim 221 co-operating with the skirt 240 to pinch the wall 10 of the tube 1** across its thickness.

FIG. 9 shows another variant in which the collar **22*c* has a peripheral rim 222 which carries the barbs 231 and 232, said barbs being separate or constituted as a single piece, and co-operating with the skirt 240 to pinch the wall 10 of the tube 1** both across its thickness and along the axis X.

Figure 10:
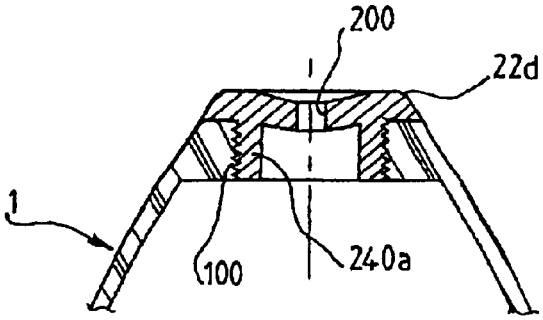
FIG. 10 is a fragmentary section view on an enlarged scale of a fifth possible embodiment of packaging of the invention.

FIG. 10 shows another variant in which the collar **22*d* carries a skirt 240*a* provided with an outside screw thread engaged in the opening 100**, which in this case is tapped.

FIG. 11 shows yet another variant in which the collar **22*e* presents both a peripheral rim 223 with internal tapping that is screwed onto the outside of the opening 100, and a skirt 240 engaged in the opening 100, the wall 10 of the tube 1 thus being pinched between the rim 223 and the skirt 240**.

As shown in FIGS. 1 to 4, the neck 11 is advantageously constituted by a special shape of the wall 10 of the hollow body which, going towards the opening 100, converges towards the main axis X progressively and monotonically, i.e. without forming any point of inflection.

As shown more precisely in FIG. 4, this shape enables the wall 10 of the hollow body 1 around the opening 100 to be defined by a generator line that slopes relatively little relative to the main axis, for example that slopes at an angle A of not more than 45°, or even not more than 30°, while nevertheless not being zero.

As shown in FIGS. 1 and 2, the collar 22 may be connected to the stopper 21 via a hinge link 25, said link 25 comprising, for example (FIG. 2) a strap 250 possibly matching the outside shape of the hollow body 1 and a hinge 251 connecting the strap 250 to the stopper 21.

In this embodiment, the stopper may optionally be held in the closed position by the finger 210 being held tightly in the dispenser orifice of the collar 22.

This packaging makes use of all of its advantages when the flexible tube is filled with the fluid it is to contain via its bottom end 120 (FIGS. 3 and 4), this end 120 being left open when the tube is made and subsequently being closed and sealed by pinching and heat-sealing the wall 10 after the tube has been filled.

Whatever the shape that is given to the hollow body 1, the invention makes it possible to provide for the wall 10 thereof to be flexible and deformable, including around the opening 100, thus making it possible for all of the fluid contained in the packaging to be delivered.

Furthermore, the stopper 21 may be shaped so that in its closed position it provides the packaging with a stand, so that the packaging can be stood on the stopper.

In this case, as shown in FIG. 1, the stopper 21 may flare away from the neck 11, the edge 26 of the stopper which is furthest from the neck 11 thus presenting a perimeter that is greater than the perimeter of the edge 27 of the stopper which is closest to the neck.

Finally, as shown generally in FIG. 1, when the stopper 1 is in the closed position, it may cover the base 20 completely, so that in other words the base is completely hidden when the packaging is closed.

What is claimed is:

1. Packaging for a fluid such as a cream or a paste, the packaging comprising a hollow body (1) and stopper means (2), the hollow body (1) being a flexible tube defined by a wall (10) suitable for being subjected at least locally to reversible deformation and terminating in a neck (11) pierced by an opening (100) centered on a main axis (X), and the stopper means (2) comprise an annular base (20) fixed to the opening (100) in order to define therein a dispenser orifice (200) for the fluid, and a stopper (21) having a closure finger (210), said stopper being connected to the base (20) via a hinge link (25) and being selectively movable relative to the base (20) by turning through an angle of more than 90° between a first position in which the finger closes the dispenser orifice and a second position in which the orifice is released, the packaging being characterized in that the neck (11) is formed by the wall (10) of the tube which converges on the main axis (X) going towards the opening (100), in that the neck (11) presents a determined minimum radius (R) in a longitudinal plane (L) containing the main axis (X), in that the hollow body (1) presents a determined circumference (C) in a plane (T) extending across the main axis (X) and situated halfway between the ends (110, 120) of the hollow body (1), in that the ratio (C/R) of the determined circumference (C) over the minimum radius (R) is not greater than five, and in that the base (20) is engaged in the opening (100), putting the neck (11) under radial tension, and is prevented from moving relative to the opening along the main axis (X).

2. Packaging according to claim 1, characterized in that the base pinches the wall (10) of the hollow body (1) around the opening (100).

3. Packaging according to claim 2, characterized in that the base (20) pinches the wall (10) of the hollow body (1) substantially parallel to the main axis (X).

4. Packaging according to claim 2, characterized in that the base (20) pinches the wall (10) of the hollow body (1) across its thickness.

5. Packaging according to claim 1, characterized in that the base (20) has barbs (231, 232) whereby the base (20) is secured to the neck (11).

6. Packaging according to claim 5, characterized in that the barbs (231, 232) are carried by elastically flexible tabs (241, 242) secured to a collar (22) surrounding the opening (100) outside the hollow body (1), said tabs (241, 242) being engaged in the opening (100) of the hollow body and extending at least approximately parallel to the main axis (x).

7. Packaging according to claim 5, characterized in that the barbs (231, 232) are carried by a substantially cylindrical skirt (240) engaged in the opening (100) of the hollow body and secured to a collar (22) surrounding the opening (100) outside the hollow body (1).

8. Packaging according to claim 7, characterized in that the link (25) comprises a strap (250) matching the outline of the neck (10) of the hollow body (1), and a hinge (251) connecting the strap (250) to the stopper (21).

9. Packaging according to claim 1, characterized in that the wall (10) of the hollow body converges progressively and monotonically towards the main axis (x) on going towards the opening (100).

10. Packaging according to claim 1, characterized in that the flexible tube has an end (120) that is initially open, for being closed subsequently by pinching and heat-sealing the wall (10).

11. Packaging according to claim 1, characterized in that the wall (10) of the hollow body (1) is flexible and deformable, including around the opening (100).

12. Packaging according to claim 1, characterized in that the wall (10) of the hollow body (1) is defined around the opening (100) by a generator line inclined at a non-zero angle (A) that is not greater than 45°, and preferably not greater than 30°, relative to the main axis (x).

13. Packaging according to claim 1, characterized in that the ratio (C/R) of the determined circumference (C) over the minimum radius (R) is not greater than two.

14. Packaging according to claim 1, characterized in that the stopper (21) is shaped in its first position to offer a stand for the packaging which can thus be stood on the stopper.

15. Packaging according to claim 14, characterized in that, in its first position, the stopper (21) presents a first edge (26) that is relatively far from the neck and of relatively large perimeter, and a second edge (27) that is relatively close to the neck and of relatively small perimeter.

16. Packaging according to claim 1, characterized in that, in its first position, the stopper (21) completely covers the base (20) of the stopper means.

* * * * *